US008388104B2

(12) United States Patent
Tanaka et al.

(10) Patent No.: US 8,388,104 B2
(45) Date of Patent: Mar. 5, 2013

(54) DETERMINING ENCODER STRIP EXPANSION

(75) Inventors: Rick M. Tanaka, Vancouver, WA (US); Algird M. Gudaitis, Vancouver, WA (US); David K. Klaffenbach, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1433 days.

(21) Appl. No.: 11/782,733

(22) Filed: Jul. 25, 2007

(65) Prior Publication Data

US 2009/0027438 A1 Jan. 29, 2009

(51) Int. Cl.
*B41J 23/00* (2006.01)

(52) U.S. Cl. ..... 347/37; 341/1

(58) Field of Classification Search ..... 347/14, 347/19, 37; 341/1
See application file for complete search history.

(56) References Cited

U.S. PATENT DOCUMENTS

| | | | | |
|---|---|---|---|---|
| 4,808,832 | A * | 2/1989 | Doggett | 250/548 |
| 4,832,518 | A * | 5/1989 | Moriyama | 400/322 |
| 5,301,559 | A * | 4/1994 | Tsuji et al. | 73/862.326 |
| 5,331,680 | A * | 7/1994 | Ueno | 377/17 |
| 5,561,449 | A | 10/1996 | Raskin et al. | |
| 5,600,350 | A * | 2/1997 | Cobbs et al. | 347/19 |
| 6,302,514 | B1 | 10/2001 | Eade et al. | |
| 6,371,593 | B1 | 4/2002 | Li et al. | |
| 6,390,588 | B1 * | 5/2002 | Ikeda | 347/19 |
| 6,407,678 | B1 * | 6/2002 | Elgee et al. | 341/8 |
| 6,471,319 | B1 * | 10/2002 | Adkins et al. | 347/11 |
| 6,499,827 | B2 | 12/2002 | Elgee | |
| 6,654,508 | B1 * | 11/2003 | Markham | 382/291 |
| 6,907,356 | B2 | 6/2005 | Swenson et al. | |
| 7,014,289 | B1 * | 3/2006 | Matsuda | 347/19 |
| 7,056,041 | B2 | 6/2006 | Swenson et al. | |
| 2003/0021613 | A1 * | 1/2003 | Koide | 399/167 |
| 2003/0098897 | A1 * | 5/2003 | Hoshino et al. | 347/19 |
| 2003/0234827 | A1 * | 12/2003 | Tsuruoka et al. | 347/14 |
| 2004/0036732 | A1 * | 2/2004 | Shoji | 347/19 |
| 2004/0125166 | A1 * | 7/2004 | Hori et al. | 347/19 |
| 2004/0131386 | A1 * | 7/2004 | Koide | 399/167 |
| 2004/0263552 | A1 * | 12/2004 | Jun | 347/14 |
| 2005/0128235 | A1 * | 6/2005 | Hung et al. | 347/14 |
| 2006/0038843 | A1 * | 2/2006 | Chen | 347/14 |
| 2007/0024659 | A1 | 2/2007 | Grosse et al. | |
| 2007/0098443 | A1 * | 5/2007 | Chen | 399/162 |
| 2008/0144073 | A1 * | 6/2008 | Griesemer et al. | 358/1.15 |

FOREIGN PATENT DOCUMENTS

| | | | |
|---|---|---|---|
| JP | 08061983 | A * | 3/1996 |
| JP | 2007171104 | A * | 7/2007 |

* cited by examiner

*Primary Examiner* — Charlie Peng
*Assistant Examiner* — Peter Radkowski

(57) ABSTRACT

A system is provided that includes an encoder strip having encoder markings, first and second optical encoders positioned at a fixed distance from one another on a substrate and, responsive to being moved along the encoder strip, configured to generate first and second signals, respectively, that each indicate detection of the encoder markings on the encoder strip and processing circuitry configured to determine a current phase difference between the first and the second signals using a first portion of the first signal that corresponds to a first plurality of encoder markings and a second portion of the second signal that corresponds to a second plurality of encoder markings.

20 Claims, 3 Drawing Sheets

DETERMINING ENCODER STRIP EXPANSION

BACKGROUND

Inkjet printing systems that include two or more print carriages align the print carriages with one another to prevent print defects from occurring when printing an image onto a print medium. The process of aligning the print carriages may be affected by environmental changes inside printing systems such as increases in temperature and humidity. The environmental changes may be caused by the application of heat to dry ink applied to a print medium. It would be desirable to prevent print defects from occurring as a result of environmental changes in a printing system.

DETAILED DESCRIPTION

In the following detailed description, reference is made to the accompanying drawings, which form a part hereof, and in which is shown by way of illustration specific embodiments in which the disclosed subject matter may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

According to one embodiment, an inkjet printing system compensates for the expansion of encoder strips due to environmental changes by measuring a phase difference in signals generated by a pair of encoders on each print carriage as the encoders move along an encoder strip. The inkjet printing system determines a measured unit change from the phase difference and adjusts the printing of image using the measured unit change to prevent print defects from appearing on a print medium.

Figure 1A:
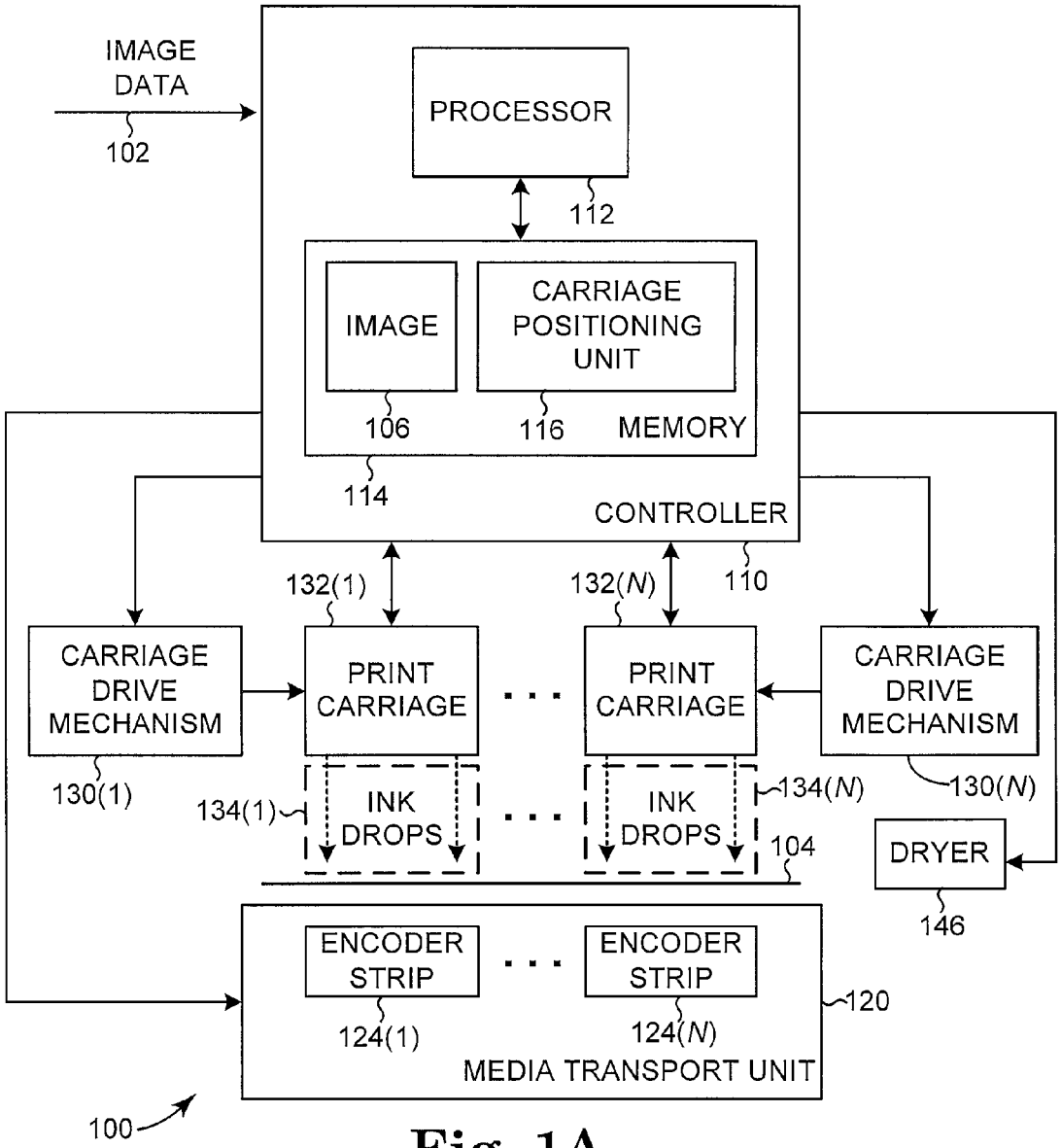
FIGS. 1A-1B are block diagrams illustrating one embodiment of an inkjet printing system.

FIG. 1A is a block diagram illustrating one embodiment of an inkjet printing system 100. Inkjet printing system 100 is configured to receive image data 102 that represents an image and cause a reproduction of the image to be formed on a print medium 104 such as paper. Inkjet printing system 100 may also include other imaging units such as a scanner and/or a fax machine (not shown).

Inkjet printing system 100 receives image data 102 from any suitable image data source (not shown) such as a computer system, a mobile device, or a storage system. Inkjet printing system 100 may connect to the image data source by any suitable connection that allows image data 102 to be received by inkjet printing system 100 such as a wired or wireless point-to-point connection or a wired or wireless network connection. The network connection may connect to a local area network (LAN), a wide area network (WAN), or a global communications network such as the Internet.

A controller 110 in system 100 includes a processor 112 and a memory 114. Controller 110 receives image data 102 and stores each set of image data 102 as an image 106 in memory 114. Image 106 represents, for example, all or a portion of a document and/or a file to be printed. Controller 110 provides signals that include print data corresponding to image 106 and control signals to a media transport unit 120, two or more carriage drive mechanisms 130(1)-130(N), and two or more print carriages 132(1)-132(N) to cause image 106 to be reproduced on print medium 104. Processor 112 executes instructions stored in memory 114 to operate system 100. Memory 114 is any suitable storage medium that is accessible to processor 112 to allow processor 112 to access and store instructions and/or data. Memory 114 may include any suitable type and/or combination of volatile and non-volatile memory devices in any suitable configuration. A carriage positioning unit 116 aligns print carriages 132 with respect to one another using encoders 142 and 144 (shown in FIG. 1B) and an encoder strip 124 for each print carriage 132 as described in additional detail below.

To print image 106, media transport unit 120 moves print medium 104 past print carriages 132(1)-132(N) in response to signals from controller 110. As print medium 104 moves past print carriages 132(1)-132(N), controller 110 provides signals and print data to carriage drive mechanisms 130(1)-130(N) and print carriages 132(1)-132(N). Carriage drive mechanisms 130(1)-130(N) scan print carriages 132(1)-132(N), respectively, back and forth across print medium 104 and print carriages 132(1)-132(N) selectively deposit or eject ink drops 134(1)-134(N), respectively, onto print medium 104 in accordance with the print data to reproduce image 106 on print medium 104. Media transport mechanism 120 may also include a media feed mechanism (not shown) to feed print medium 104 and/or one or more media supply tray (not shown) to store additional print media 104.

Figure 1B:
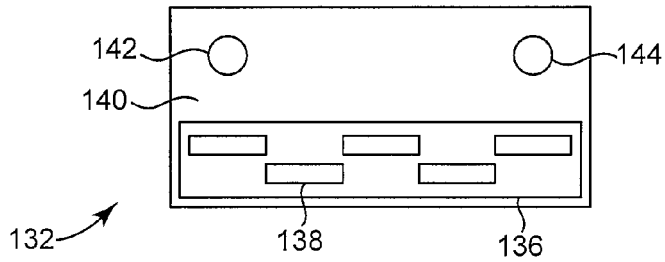

Referring to FIG. 1B, each print carriage 132 includes a printhead array 136 of one or more printheads 138 mounted on, attached to, integrally formed with, or otherwise affixed to a substrate 140. Each printhead 138 is configured to selectively deposit or eject drops of ink 134 onto print medium 104. The ink deposited or ejected by printheads 138 may be propelled by thermal heating, piezoelectric actuators, or another suitable mechanism. The set of printheads 138 in each printhead array 136 may deposit or eject one or more colors of ink. A dryer 146 provides heat to dry the ink on print medium 104 in response to signals from controller, 110.

Each print carriage 132 also includes a pair of encoders 142 and 144 that are used in conjunction with an encoder strip 124 (shown in FIG. 1A) to align print carriages 132 with respect to one another. Each encoder strip 124 is positioned relative to media transport mechanism 120 so that corresponding pairs of encoders 142 and 144 pass over each encoder strip 124 as a print carriage 132 moves across print medium 104 as will be described in additional detail below.

Figure 2:
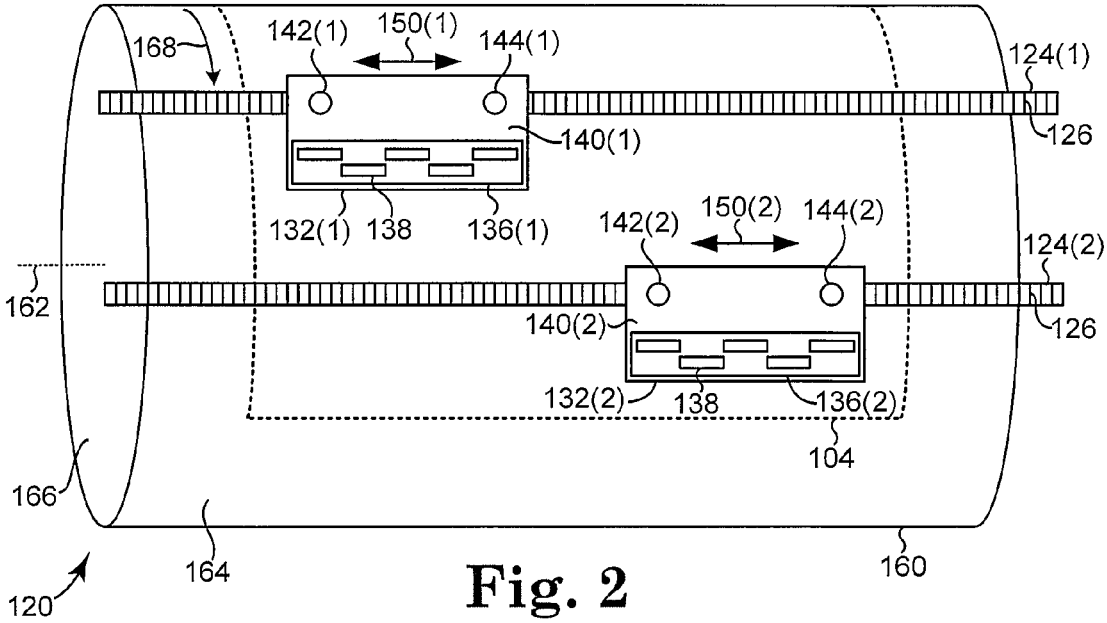
FIG. 2 is a schematic diagram illustrating one embodiment of selected portions of an inkjet printing system.

FIG. 2 is a schematic diagram illustrating one embodiment of selected portions of inkjet printing system 100 with two print carriages 132(1) and 132(2) where each print carriage 132(1) and 132(2) prints to a different portion of a page width of print medium 104.

In the embodiment of FIG. 2, media transport unit 120 includes a cylindrical drum 160. Drum 160 rotates around an axis 162 that is parallel to a outer surface 164 of drum 160 and centered with reference to side surfaces 166 of drum 160. Media transport unit 120 rotates drum 160 to move print medium 104 past printheads 138 on print carriages 132(1)

and 132(2) as indicated by an arrow 168. As it rotates past print carriages 132(1) and 132(2), print medium 104 is held stationary on drum 160 by air suction or another suitable technique.

To print swaths of image 106 along the width of print medium 104, media transport unit 120 rotates drum 160 to position print medium 104 with respect to printhead arrays 136(1) and/or 136(2). Printhead arrays 136(1) and/or 136(2) deposit or eject ink onto print medium 104 as print carriages 132(1) and/or 132(2) are moved along the width of print medium 104 (i.e., parallel to axis 162) as indicated by arrows 150(1) and 150(2), respectively, while drum 160 is stationary. Each printhead array 136(1) and 136(2) prints to a different portion of a page width of print medium 104 where the page width is parallel with axis 162. After printhead arrays 136(1) and/or 136(2) complete the swath or swaths, media transport unit 120 rotates drum 160 to advance print medium 104 with respect to printhead arrays 136(1) and/or 136(2) for a next swath or swaths. Each print swath may have a width of approximately one inch, for example.

Printhead arrays 136(1) and 136(2) may form the entire image 106 on print medium 104 in one revolution of drum 160 (i.e., print medium 104 moves past printhead arrays 136(1) and 136(2) once) or multiple revolutions of drum 160 (i.e., print medium 104 moves past printhead arrays 136(1) and 136(2) more than once).

Because printhead arrays 136(1) and 136(2) print to different portions of the page width of print medium 104, inkjet printing system 100 accurately positions print carriages 132(1) and 132(2) relative to each other to prevent print defects from occurring where the print boundaries of the portions formed by printhead arrays 136(1) and 136(2) on print medium 104 intersect. If print carriages 132(1) and 132(2) are not properly aligned, defects such as a light or dark line or a visible discontinuity at the joint may occur at the intersection of the print boundaries.

Inkjet printing system 100 uses the pair of encoders 142 and 144 in conjunction with a corresponding encoder strip 124 to align each print carriage 132 with respect to the remaining print carriages 132. In the embodiment of FIG. 2, inkjet printing system 100 uses encoders 142(1) and 144(1) and encoder strip 124(1) to track a location of print carriage 132(1). Similarly, inkjet printing system 100 uses encoders 142(2) and 144(2) and encoder strip 124(2) to track a location of print carriage 132(2). By tracking the location of print carriages 132(1) and 132(2), inkjet printing system 100 is able to align print carriages 132(1) and 132(2) with respect to each other to prevent print defects from occurring on print medium 104.

Each encoder strip 124 spans the width of drum 160 parallel to axis 162 of rotation and has encoder markings 126 at set intervals along the width. One end of each encoder strip 124 is in a fixed position relative to drum 160 and the other end of each encoder strip 124 is spring loaded to allow for expansion along the width of drum 160. In one embodiment, each encoder strip 124 is made out of a transparent material such as Mylar or polyester film with encoder markings 126 that are dark or opaque regions to form a sharp visible contrast with the transparent material. In other embodiments, encoder strips 124 may be formed with other materials with other suitable encoder markings 126. In one embodiment, encoder markings 126 are spaced at 1/200 inch intervals along the length of encoder strip 124. In other embodiments, encoder markings 126 may be spaced at other intervals along the length of encoder strip 124.

In operation, inkjet printing system 100 may produce variations in temperature and humidity that cause encoder strips 124 to expand. For example, heat from dryer 146 and/or humidity from deposited or ejected ink may increase the temperature and/or humidity in inkjet printing system 100. As a result of hygroscopic and/or thermal expansions of encoder strips 124, the relative positions of print carriages 132 with respect to encoder strips 124 may change and, if not compensated for, may produce print defects from dot placement errors at the intersection of the print boundaries between print carriages 132.

Inkjet printing system 100 compensates for the expansion of encoder strips 124 by measuring a phase difference in signals generated by encoders 142 and 144 on each print carriage 132 as encoders 142 and 144 move along encoder strip 124. Inkjet printing system 100 determines a measured unit change from the phase difference and adjusts the printing of image 106 by printheads 138 using the measured unit change to prevent print defects from appearing on print medium 104.

Inkjet printing system 100 may determine the phase difference between encoder signals any time encoders 142 and 144 move along encoder strip 124. Accordingly, inkjet printing system 100 may determine the phase difference while image 106 is being printed or at any suitable time before or after image 106 is printed (e.g. during an alignment or servicing routine for printheads 138).

Figure 3:
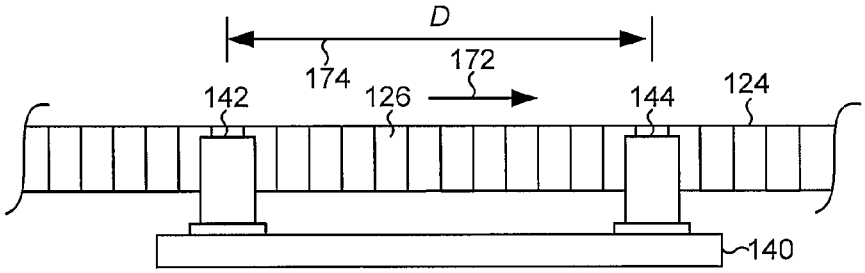
FIG. 3 is a schematic diagram illustrating one embodiment of encoders and an encoder strip.

FIG. 3 is a schematic diagram illustrating one embodiment of encoders 142 and 144 and encoder strip 124. As shown in FIG. 3, encoders 142 and 144 are mounted on, attached to, integrally formed with, or otherwise affixed to substrate 140 at a fixed distance D from one another. The fixed distance D is sufficient to allow a reasonable measurement of expansion of encoder strip 124. For example, the fixed distance D may be 100 mm in one embodiment.

Substrate 140 is formed of either a relatively invariant material such as Invar or a material with well known expansion coefficient. Invar is an alloy material with a very small coefficient of thermal expansion and substantially no hygroscopic expansion that was originally developed for use in mechanical clocks. If a material with well known expansion coefficient is used, a temperature reading device (not shown) may also be used to estimate the thermal expansion of substrate 140. Substrate 140 positioned with sufficient proximity to encoder strip 124 that allows encoders 142 and 144 to detect encoder markings 126 as encoders 142 and 144 are moved along encoder strip 124.

Encoders 142 and 144 each optically scan encoder strip 124 to generate one or more analog electrical signals that indicate the presence or absence of encoder marks 126 as encoders 142 and 144 are moved in unison along encoder strip 124. Because of the fixed distance between encoders 142 and 144, the signals generated by encoders 142 and 144 correspond to at least partially different sets of encoder marks 126. In one embodiment, each encoder 142 and 144 generates four signals—a channel A signal, a channel B signal, an inverted channel A signal, and an inverted channel B signal. In other embodiments, encoder 142 and 144 generate another signal or signals.

Encoders 142 and 144 each provide the signal or signals to controller 110. In one embodiment, encoders 142 and 144 are directly coupled to general purpose input/output (GPIO) ports of processor 112 and each provide a signal as a digital input to a GPIO port of processor 112. In other embodiments, encoders 142 and 144 each provide the signal or signals directly or indirectly to controller 110 in other suitable ways.

Figure 4:
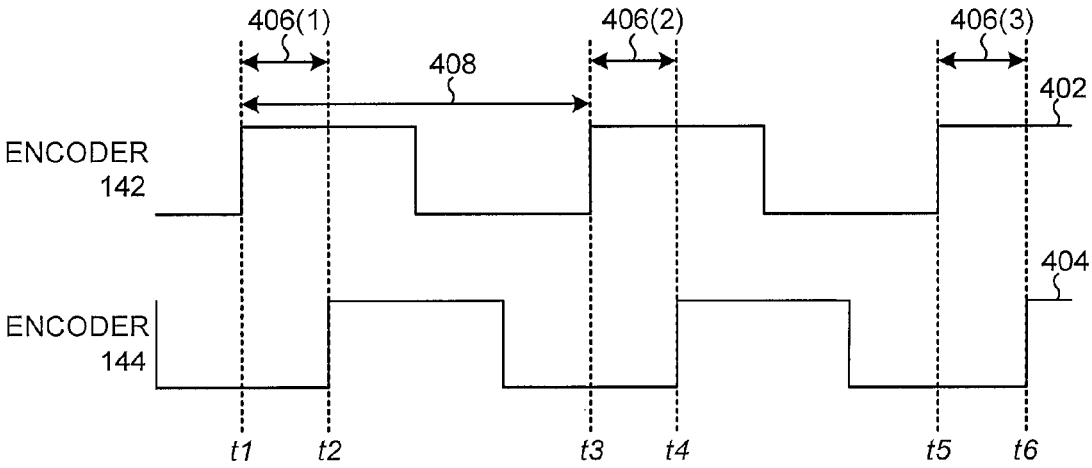
FIG. 4 is a timing diagram illustrating one embodiment of encoder signals.

FIG. 4 is a timing diagram illustrating one embodiment of an encoder signal 402 generated by encoder 142 and an encoder signal 404 generated by encoder 144 as encoders 142 and 144 are moved along encoder strip 124. In signals 402 and 404, the signal transitions (i.e., the signal changes from a low to a high signal level or from a high to a low signal level) each indicate an edge, and therefore a location, of a corresponding encoder mark 126. Accordingly, one signal level (e.g., a low signal level) indicates the presence of a corresponding encoder mark 126 and the other signal level (e.g., a high signal level) indicates the absence of a corresponding encoder mark 126.

Figure 5A:
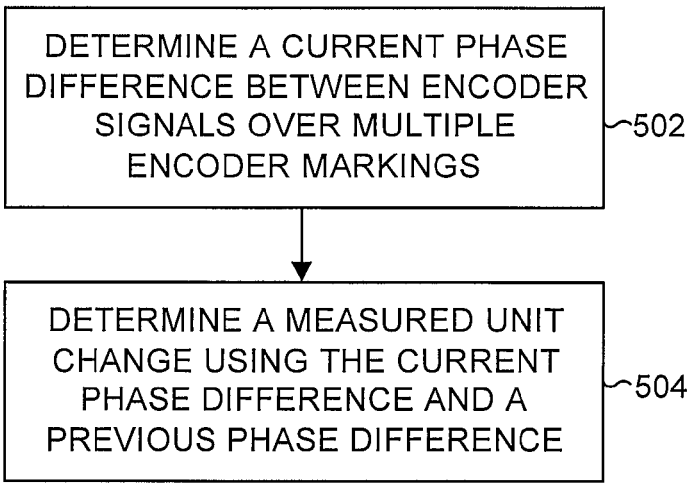
FIGS. 5A-5B are flow charts illustrating embodiments of a method for compensating for the expansion of an encoder strip.

One embodiment of the operation of compensating for the expansion of encoder strip 124 will now be described with reference to FIG. 5A. FIG. 5A is a flow chart illustrating one embodiment of a method for compensating for the expansion of an encoder strip. The method of FIG. 5A will be described as being performed by carriage positioning unit 116. In other embodiments, other components of controller 110 may perform all or portions of the method of FIG. 5A. Carriage positioning unit 116 performs the method of FIG. 5A for each print carriage 132(1)-132(N) with respective encoder strip 124(1)-124(N) in one embodiment.

In FIG. 5A, carriage positioning unit 116 is configured to determine a phase difference between encoder signals over multiple encoder strip markings as indicated in a block 502. Carriage positioning unit 116 examines the encoder signals from encoders 142 and 144 over two or more encoder markings 126 for each encoder 142 and 144 to determine two or more phase lags. Carriage positioning unit 116 determines each phase lag by comparing corresponding signal transitions (e.g., rising or falling edges), which each indicate the location of an encoder marking 126) in the encoder signals. In the example of FIG. 4, carriage positioning unit 116 determines phase lags 406(1), 406(2), and 406(3) between rising edges of signals 402 and 404. In one embodiment, carriage positioning unit 116 determines each phase lag 406 by counting the number of clock cycles of processor 112 between each rising edge in signal 402 and each rising edge in signal 404. In this embodiment, the clock frequency of the clock of processor 112 is substantially higher than the frequency of the encoder signals to allow a sufficient number of processor clock cycles to occur between the rising or falling edges of the encoder signals.

Carriage positioning unit 116 averages or otherwise combines phase lags 406(1), 406(2), and 406(3) to determine the phase difference. By determining the phase difference from two or more phase lags, carriage positioning unit 116 may minimize the effect of noise on the encoder signals.

Carriage positioning unit 116 determines a measured unit change using the phase difference as indicated in a block 504. Carriage positioning unit 116 determines the measured unit change by comparing the current phase difference with a previously determined phase difference. Carriage positioning unit 116 may determine the previous phase difference using the method of FIG. 5A at any time prior to determining the current phase difference. For example, carriage positioning unit 116 may determine the previous phase difference during an initial alignment of printheads 138 or during the printing of image 106 or a previous image 106.

Carriage positioning unit 116 determines the measured unit change as any suitable function of the current phase difference, the previous phase difference, and the spacing of encoder markings 126 on encoder strip 124. For example, carriage positioning unit 116 may determine the measured unit change as proportional to the difference between the current and previous phase differences. Where the current and previous phase differences, $Ph_{cur}$ and $Ph_{prev}$, respectively, are measure in electrical degrees, carriage positioning unit 116 may determine an approximation of the measured unit change, Δ, as shown in Equation I where Space represents the spacing of encoder markings 126.

$$\Delta = \left(\frac{Ph_{cur} - Ph_{prev}}{360°}\right)\text{Space} \qquad \text{Equation I}$$

Using the measured unit change, carriage positioning unit 116 adjusts the printing of image 106 by printheads 138 to prevent print defects from appearing on print medium 104 as a result of the expansion of encoder strip 124.

Figure 5B:
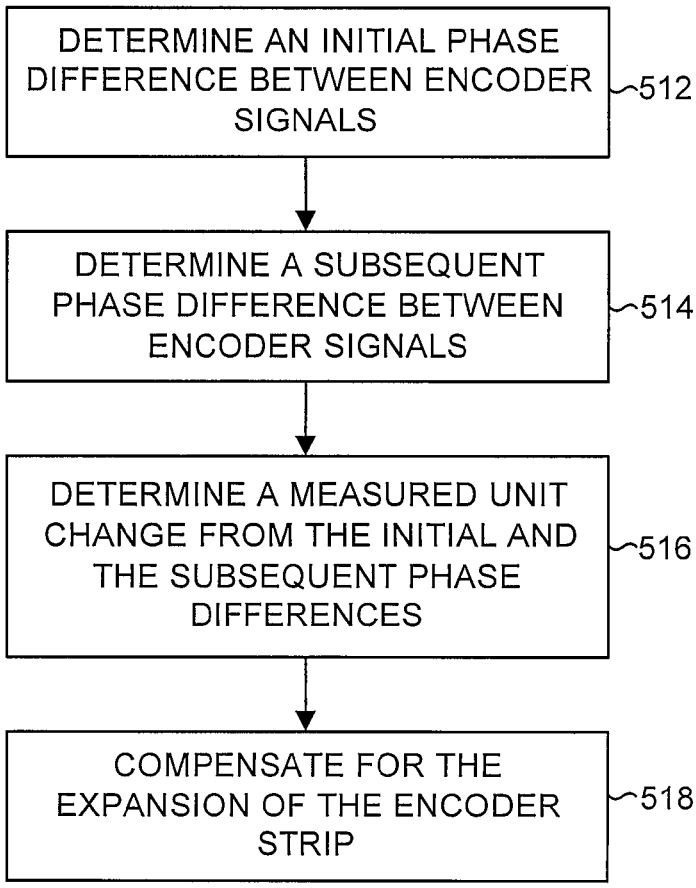

Another embodiment of the operation of compensating for the expansion of encoder strip 124 will now be described with reference to FIG. 5B. FIG. 5B is a flow chart illustrating one embodiment of a method for compensating for the expansion of an encoder strip. The method of FIG. 5B will be described as being performed by carriage positioning unit 116. In other embodiments, other components of controller 110 may perform all or portions of the method of FIG. 5B. Carriage positioning unit 116 performs the method of FIG. 5B for each print carriage 132(1)-132(N) with respective encoder strip 124(1)-124(N) in one embodiment.

In FIG. 5B, carriage positioning unit 116 determines an initial phase difference between encoder signals from encoders 142 and 144 as indicated in a block 512. Carriage positioning unit 116 determines a subsequent phase difference between encoder signals from encoders 142 and 144 as indicated in a block 514.

Carriage positioning unit 116 may determine the initial phase difference at any suitable time such as during an initial alignment of printheads 138 or during the printing of image 106 or a previous image 106. Carriage positioning unit 116 may determine the subsequent phase difference at any suitable time subsequent to the determination of the initial phase difference. For example, carriage positioning unit 116 may determine the subsequent phase difference at continuous or periodic intervals and/or in response to certain events occurring such as the printing of image 106.

Carriage positioning unit 116 may determine each of the initial and subsequent phase differences from two or more phase lags corresponding to two or more encoder markings 126 in each of the encoder signals from encoders 142 and 144. For example, where encoder markings 126 are spaced at 1/200 inch intervals, carriage positioning unit 116 may determine each of the initial and subsequent phase differences by averaging approximately 800 phase lags over four inch moves (i.e., 200 phase lags per inch) of encoders 142 and 144 along encoder strip 124 at different times.

Carriage positioning unit 116 may determine each phase lag by counting the number of clock cycles of processor 112 between corresponding rising or falling edges in the encoder signals from encoders 142 and 144. Carriage positioning unit 116 may record the number of clock cycles of processor 112 as a fraction of the clock cycles in a full period of the encoder channels. Carriage positioning unit 116 may determine the full period from consecutive two or more rising or falling edges in the encoder signal from encoder 142 and/or two or more rising or falling edges in the encoder signal from encoder 144. As an example, carriage positioning unit 116 may determine the initial phase difference to be 15 electrical degrees and the subsequent phase difference to be 105 electrical degrees.

Carriage positioning unit 116 determines a measured unit change from the initial and subsequent phase differences as indicated in a block 516. Carriage positioning unit 116 determines the measured unit change as proportional to the difference between the initial and subsequent phase differences. Using Equation I with the above example initial and subsequent phase differences and encoder markings 126 spaced at 1/200 inch intervals or 0.127 mm/100 mm, the measured unit change may be determined to be ((105-15 degrees)/360 degrees))(0.127 mm/100 mm) or 0.03175 mm/100 mm. Accordingly, carriage positioning unit 116 determines that encoder strip 124 has expanded by 0.03175 mm over 100 mm of length of encoder strip 124.

Carriage positioning unit 116 compensates for the expansion of encoder strip 124 using the measured unit change as indicated in a block 518. Carriage positioning unit 116 adjusts the printing of image 106 by printheads 138 using the measured unit change to prevent print defects from appearing on print medium 104 as a result of the expansion of encoder strip 124. In one embodiment, carriage positioning unit 116 adjusts the positioning of print carriage 132 in accordance with Equation II where $N_{POS}$ is the nominal position of print carriage 132 and $N_{CORR}$ is the corrected position of print carriage 132.

$$N_{CORR} = \frac{N_{POS}}{1+\Delta} \qquad \text{Equation II}$$

Because the term 1+Δ may be very close to a value of one, the calculation of $N_{CORR}$ using Equation II may be a numerically sensitive calculation that may result in rounding errors and/or the use of a significant amount of computing power. By substituting Equation III into Equation II, Equation IV may be derived.

$$\frac{1}{1+\Delta} \approx 1-\Delta \qquad \text{Equation III}$$

$$N_{CORR} = N_{POS}(1-\Delta) = N_{POS} - (N_{POS} * \Delta) \qquad \text{Equation IV}$$

In another embodiment, carriage positioning unit 116 adjusts the positioning of print carriage 132 in accordance with Equation IV to achieve a more stable calculation compared to the calculation of Equation II.

For example, if the desired nominal position of print carriage 132 is 350 mm from the fixed end of encoder strip 124 and the measured unit change is 0.03175 mm/100 mm from the example above, carriage positioning unit 116 determines the corrected position to be (350 mm)−(350 mm*(0.03175 mm/100 mm))=349.888875 mm from the fixed end of encoder strip 132.

In some embodiments, the expansion of encoder strip 124 may be large enough to cause the phase difference to exceed 360 degrees. In these embodiments, carriage positioning unit 116 may sample the phase difference frequently to detect when the phase difference exceeds 360 degrees. In other embodiments, the resolution of encoders 142 and 144 and/or the spacing between encoders 142 and 144 may be selected to allow for expansion ranges of encoder strip 124 where the phase difference does not exceed 360 degrees.

The above embodiments may provide advantages over other techniques for compensating for the expansion of encoder strips. For example, the above embodiments may perform the compensation without printing alignment markings onto a print medium. In addition, the above embodiments may reduce the effect of any noise in the samples by using a large number of measurement samples to significantly attenuate the noise from external noise sources such as mechanical vibrations caused by the measurement. Further, the above embodiments may be performed at any time during the normal operation of inkjet printing system. As a result, the measured unit change may be updated frequently (e.g., every few seconds) without reducing the throughput of inkjet printing system 100.

Although specific embodiments have been illustrated and described herein for purposes of description of the embodiments, it will be appreciated by those of ordinary skill in the art that a wide variety of alternate and/or equivalent implementations may be substituted for the specific embodiments shown and described without departing from the scope of the present disclosure. Those with skill in the art will readily appreciate that the present disclosure may be implemented in a very wide variety of embodiments. This application is intended to cover any adaptations or variations of the disclosed embodiments discussed herein. Therefore, it is manifestly intended that the scope of the present disclosure be limited by the claims and the equivalents thereof.

What is claimed is:

1. A system comprising:

an encoder strip having encoder markings;

first and second optical encoders positioned at a fixed distance from one another on a substrate and, responsive to being moved along the encoder strip, configured to generate first and second signals, respectively, that each indicate detection of the encoder markings on the encoder strip; and processing circuitry configured to determine a current phase difference between the first and the second signals using a first portion of the first signal that corresponds to a first plurality of encoder markings and a second portion of the second signal that corresponds to a second plurality of encoder markings.

2. The system of claim 1 wherein the processing circuitry is configured to determine an amount of expansion of the encoder strip using the current phase difference and a previous phase difference.

3. The system of claim 2 wherein the processing circuitry is configured to compensate for the amount of expansion of the encoder strip.

4. The system of claim 1 wherein the processing circuitry is configured to determine a measured unit change as proportional to a difference between the current phase difference and a previous phase difference.

5. The system of claim 1 wherein the processing circuitry is configured to determine a plurality of phase lags from the first portion of the first signal and the second portion of the second signal.

6. The system of claim 5 wherein the processing circuitry is configured to average the plurality of phase lags to determine the current phase difference.

7. The system of claim 1 wherein the substrate is formed of an invariant material.

8. The system of claim 1 further comprising:

a plurality of printheads on the substrate.

9. The system of claim 8 further comprising:

a media transport mechanism configured to move a print medium past the printheads;

wherein the encoder strip is positioned relative to the media transport mechanism.

10. The system of claim 9 where the media transport mechanism includes a drum configured to rotate the print medium past the printheads.

11. A method comprising:

detecting a first plurality of encoder markings with a first encoder as the first encoder moves along an encoder strip;

detecting a second plurality of encoder markings with a second encoder as the second encoder moves in unison with the first encoder along the encoder strip; and determining a current phase difference corresponding to two or more locations of the first plurality of encoder markings detected by the first encoder relative to two or more locations of the second plurality of encoder markings detected by the second encoder.

12. The method of claim 11 further comprising:

determining a measured unit change that indicates an amount of expansion of the encoder strip using the current phase difference and a previous phase difference.

13. The method of claim 11 further comprising:

printing an image onto a print medium while detecting the first and the second pluralities of encoder markings.

14. The method of claim 13 further comprising:

adjusting the printing of the image in accordance with the current phase difference.

15. The method of claim 11 wherein the first plurality of encoder markings at least partially differ from the second plurality of encoder markings.

16. A system comprising:

a print medium transport unit;

an encoder strip spanning a length of the print medium unit and having encoder markings;

a first print carriage including a printhead array and first and second optical encoders position at a fixed distance from one another;

a carriage drive mechanism configured to move the first print carriage relative to the print medium transport unit and the encoder strip;

the first optical encoder being configured to generate a first signal that indicates detection of a first set of two or more of encoder markings on the encoder strip responsive to being moved along the encoder strip;

the second optical encoder being configured to generate a second signal that indicates detection of a second set of two or more of encoder markings on the encoder strip responsive to being moved along the encoder strip; and a controller configured to determine a current phase difference from two or more transitions in the first signal that correspond to the first set of encoder markings and two or more transitions in the second signal that correspond to the second set of encoder markings.

17. The system of claim 16 wherein the controller is configured to determine a measured unit change that indicates an amount of expansion of the encoder strip using the current phase difference and a previous phase difference.

18. The system of claim 16 wherein the encoder strip includes a first end fixed relative to the print medium transport unit, and a second end movable relative to the print medium transport unit.

19. The system of claim 16, wherein the controller is configured to determine a plurality of phase lags from the first portion of the first signal and the second portion of the second signal, and to average the plurality of phase lags to determine the current phase difference.

20. The system of claim 16 wherein the first set of encoder markings at least partially differ from the second set of encoder markings.

* * * * *

UNITED STATES PATENT AND TRADEMARK OFFICE

CERTIFICATE OF CORRECTION

PATENT NO. : 8,388,104 B2
APPLICATION NO. : 11/782733
DATED : March 5, 2013
INVENTOR(S) : Rick M. Tanaka et al.

It is certified that error appears in the above-identified patent and that said Letters Patent is hereby corrected as shown below:

In the Claims

In column 9, line 32, in Claim 16, delete “position” and insert -- positioned --, therefor.

In column 10, line 6, in Claim 16, delete “of encoder” and insert -- of the encoder --, therefor.

In column 10, line 9, in Claim 16, delete “of encoder” and insert -- of the encoder --, therefor.

Signed and Sealed this
Twenty-fifth Day of June, 2013

Teresa Stanek Rea
*Acting Director of the United States Patent and Trademark Office*